US008448462B2

(12) United States Patent
Shin et al.

(10) Patent No.: US 8,448,462 B2
(45) Date of Patent: May 28, 2013

(54) SYSTEM AND METHOD FOR MAKING ICE

(75) Inventors: Jong Min Shin, Busan (KR); Ju Hyun Kim, Jinhae (KR)

(73) Assignee: LG Electronics Inc., Seoul (KR)

( * ) Notice: Subject to any disclaimer, the term of this patent is extended or adjusted under 35 U.S.C. 154(b) by 415 days.

(21) Appl. No.: 11/969,024

(22) Filed: Jan. 3, 2008

(65) Prior Publication Data

US 2008/0155999 A1 Jul. 3, 2008

Related U.S. Application Data

(60) Provisional application No. 60/883,316, filed on Jan. 3, 2007.

(51) Int. Cl.

| | |
|---|---|
| ***F25D 3/02*** | (2006.01) |
| ***F25D 25/00*** | (2006.01) |
| ***F25C 1/00*** | (2006.01) |
| ***F25C 5/08*** | (2006.01) |

(52) U.S. Cl.
USPC ..... 62/425; 62/420; 62/353; 62/377; 62/351

(58) Field of Classification Search
USPC ..... 62/66, 351–353, 81, 83, 420, 425, 62/377
See application file for complete search history.

(56) References Cited

U.S. PATENT DOCUMENTS

| | | | | |
|---|---|---|---|---|
| 2,717,505 | A | 9/1955 | Andersson | |
| 2,871,673 | A * | 2/1959 | Richards et al. | 62/174 |
| 2,912,836 | A * | 11/1959 | Harle | 62/353 |
| 3,144,078 | A | 8/1964 | Evans et al. | |
| 3,308,632 | A | 3/1967 | Winfield, Jr. | |
| 3,788,089 | A | 1/1974 | Graves | |
| 4,199,956 | A * | 4/1980 | Lunde | 62/138 |
| 4,922,723 | A * | 5/1990 | Broadbent | 62/72 |
| 5,127,236 | A | 7/1992 | Von Blanquet | |
| 5,203,176 | A * | 4/1993 | De Weered | 62/138 |
| 5,297,394 | A | 3/1994 | Frohbieter et al. | |
| 5,408,844 | A | 4/1995 | Stokes | |
| 5,787,723 | A | 8/1998 | Mueller et al. | |
| 6,205,807 | B1 * | 3/2001 | Broadbent | 62/347 |
| 6,425,259 | B2 | 7/2002 | Nelson et al. | |
| 7,017,364 | B2 | 3/2006 | Lee et al. | |
| 7,188,479 | B2 | 3/2007 | Anselmino et al. | |
| 7,681,406 | B2 | 3/2010 | Cushman et al. | |
| 2001/0025505 | A1 * | 10/2001 | Nelson et al. | 62/371 |
| 2003/0167787 | A1 | 9/2003 | Ohashi et al. | |
| 2004/0083753 | A1 * | 5/2004 | Kim et al. | 62/352 |
| 2004/0107721 | A1 | 6/2004 | Choi et al. | |

(Continued)

OTHER PUBLICATIONS

U.S. Office Action issued in U.S. Appl. No. 11/969,067 dated Nov. 19, 2009.

(Continued)

*Primary Examiner* — Frantz Jules
*Assistant Examiner* — Cassey D Bauer
(74) *Attorney, Agent, or Firm* — KED & Associates, LLP

(57) ABSTRACT

A system and method for making ice is provided. The system for making ice may include a tray for containing water to be used for making ice, and an ice-making pipe positioned so that at least a portion thereof is submerged in the water contained in the tray. A refrigerant of relatively low temperature flows through the ice-making pipe during an ice-making process, while a refrigerant of relatively high temperature flows through the ice-making pipe during an ice-releasing process.

16 Claims, 6 Drawing Sheets

U.S. PATENT DOCUMENTS

| | | | | |
|---|---|---|---|---|
| 2004/0237565 | A1 | 12/2004 | Lee et al. | |
| 2005/0061016 | A1 | 3/2005 | Lee et al. | |
| 2005/0061018 | A1 * | 3/2005 | Kim et al. | 62/344 |
| 2005/0067406 | A1 | 3/2005 | Rajarajan et al. | |
| 2005/0126202 | A1 | 6/2005 | Shoukyuu et al. | |

OTHER PUBLICATIONS

U.S. Office Action issued in U.S. Appl. No. 11/969,076 dated Mar. 10, 2010.
U.S. Office Action issued in U.S. Appl. No. 11/969,054 dated Jun. 1, 2010.
U.S. Office Action issued in U.S. Appl. No. 11/969,076 dated Oct. 14, 2010.
U.S. Office Action issued in U.S. Appl. No. 11/969,054 dated Jan. 12, 2012.
U.S. Office Action issued in U.S. Appl. No. 11/969,067 dated Jan. 17, 2012.
U.S. Office Action issued in U.S. Appl. No. 11/969,054 dated Apr. 25, 2012.
U.S. Office Action issued in U.S. Appl. No. 11/969,067 dated Apr. 25, 2012.
U.S. Office Action issued in U.S. Appl. No. 11/969,076 dated May 4, 2012.
U.S. Office Action issued in U.S. Appl. No. 13/218,587 dated Nov. 27, 2012.

* cited by examiner

SYSTEM AND METHOD FOR MAKING ICE

CROSS-REFERENCE TO RELATED APPLICATION(S)

This application claims priority under 35 U.S.C. §119 to U.S. Provisional Application No. 60/883,316 filed on Jan. 3, 2007, whose entire disclosure is hereby incorporated by reference.

BACKGROUND OF THE INVENTION

1. Field of the Invention

The present invention relates to a system and method for making ice, and more particularly, to an ice maker provided in a refrigerator and an ice making method using the same.

2. Description of the Related Art

Generally, a refrigerator is an electric home appliance for storing foods in a low temperature state so that the foods can be kept in a fresh state for an extended period of time.

Specifically, a refrigerator includes a refrigerating chamber that is maintained in a temperature range of 1 to 4° C. to store foods such as vegetables in a fresh state, and a freezing chamber that is maintained at about −18° C. to store foods such as meat or fish in a frozen state.

In addition, refrigerators are classified into a type in which a freezing chamber is positioned above a refrigerating chamber, a type in which a freezing chamber is positioned below a refrigerating chamber, and a type in which a freezing chamber and a refrigerating chamber are positioned side by side.

Alternatively, refrigerators may be classified into a side-by-side door refrigerator having right and left doors, and a single-side door refrigerator having upper and lower doors.

Furthermore, an ice maker for making ice and an ice bank for storing the ice are provided in any one of the refrigerating chamber and the freezing chamber.

Specifically, in a case where the ice maker and the ice bank are provided in the freezing chamber, water stored in the ice maker is made into ice by means of a refrigerant that has passed through an evaporator, and the ice falls into the ice bank provided below the ice maker and is stored therein.

Meanwhile, in a case where the ice maker is provided in the refrigerating chamber, there is a difficult problem in that it is not easy to make ice using cold air supplied to the refrigerating chamber since the refrigerating chamber is kept at a temperature above zero. That is, in a case where the ice maker is provided in the refrigerating chamber, there is a problem in that ice cannot be completely made, or the ice is immediately melted although being made.

SUMMARY OF THE INVENTION

The present invention is conceived to solve the aforementioned problems in the prior art. Accordingly, an object of the present invention is to provide a system and method for making ice of a refrigerator, which facilitates to make ice although an ice maker is provided in a refrigerating chamber.

Another object of the present invention is to provide a system and method for making ice, which allows the ice to be easily separated from the ice maker after the ice is made.

A system for making ice according to one aspect of the present invention for achieving the objects comprises a tray for containing a water to be used for making ice; and an ice-making pipe disposed so that at least a portion thereof is submerged in the water contained in the tray, wherein a refrigerant of relatively low temperature flows to the ice-making pipe during an ice-making process, while a refrigerant of relatively high temperature flows to the ice-making pipe during an ice-releasing process.

A system for making water according to another aspect of the present invention comprises a compressor; a condenser for allowing a refrigerant having passed through the compressor to flow in the condenser; an expansion valve for expanding a refrigerant having passed through the condenser into a refrigerant of relatively low temperature and low pressure; an ice-making pipe that extends from an outlet of the expansion valve and is curved or bent several times to form a plurality of protrusions; and a tray that contains water to be used for making ice and is rotated during an ice-making process, wherein the protrusions are at least partially submerged in the water to be used for making ice.

A method for making ice according to a further aspect of the present invention for achieving the objects comprises the steps of: storing water to be used for making ice in a tray; causing a refrigerant of relatively low temperature to flow through an ice-making pipe provided in an inner space of the tray; forming ice on a surface of the ice-making pipe; and releasing the ice formed on the surface of the ice-making pipe.

With the structure described above, it is possible to easily make ice although the ice maker is provided in a refrigerating chamber.

BRIEF DESCRIPTION OF THE DRAWINGS

The above and other objects, features and advantages of the present invention will become apparent from the following description of a preferred embodiment given in conjunction with the accompanying drawings, in which.

DESCRIPTION OF THE PREFERRED EMBODIMENT

Hereinafter, a specific embodiment of the present invention will be described in detail with reference to the accompanying drawings. However, the spirit of the present invention is not limited to the following embodiment, and retrograde embodiments or other embodiments included in the scope of the present invention can be easily conceived by adding, changing or eliminating other components.

Figure 1:
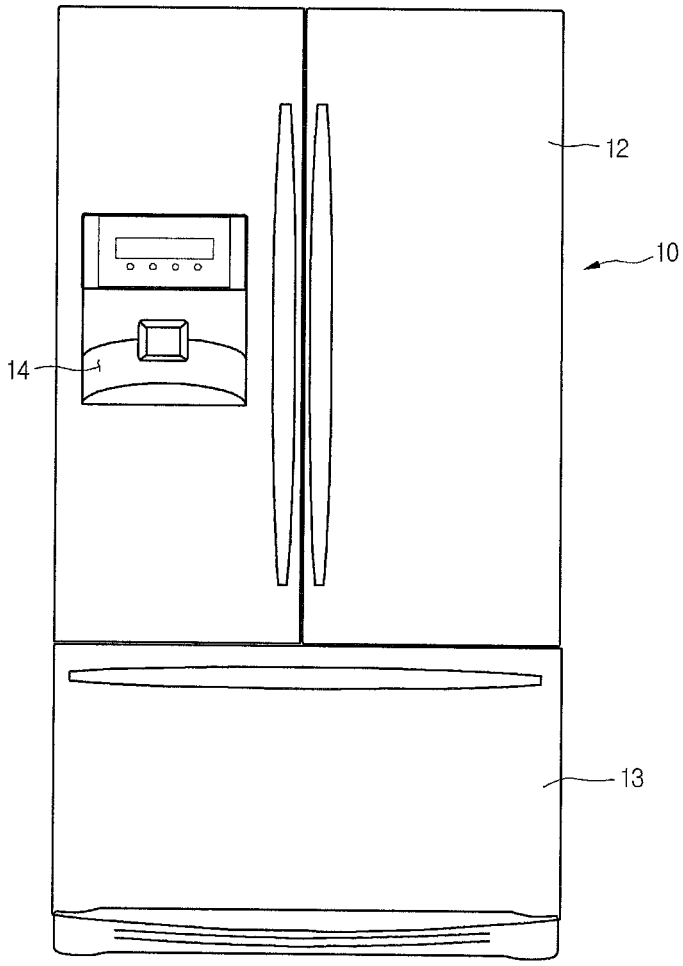
FIG. 1 is a front view of a refrigerator having an ice maker according to the present invention.
Figure 2:
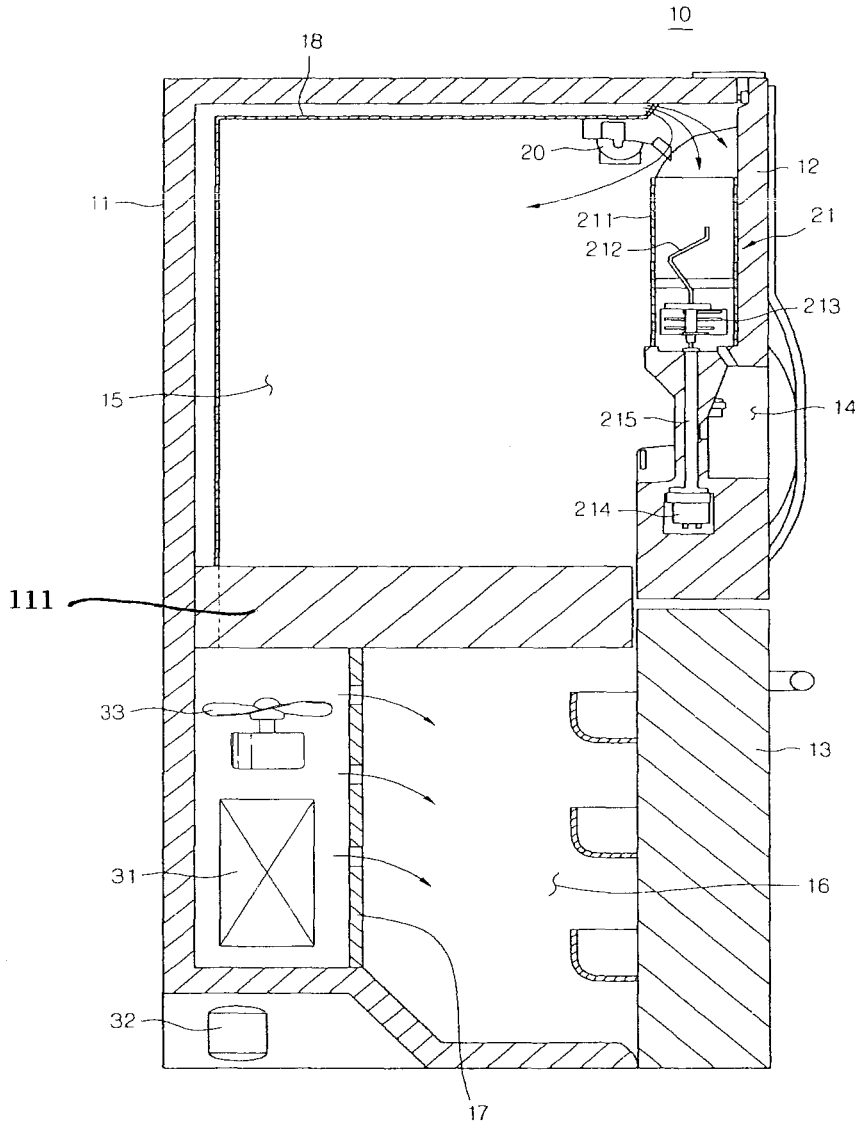
FIG. 2 is a side sectional view of the refrigerator according to the present invention.

FIG. 1 is a front view of a refrigerator having an ice maker according to the present invention, and FIG. 2 is a side sectional view of the refrigerator according to the present invention.

Referring to FIGS. 1 and 2, the refrigerator of the present invention will be described by way of example in connection with a bottom-freezer type refrigerator in which a refrigerating chamber is provided at an upper portion and a freezing chamber is provided at a lower portion.

The refrigerator 10 of the present invention includes a main body 11 having a refrigerating chamber 15 and a freezing chamber 16 provided therein, refrigerating chamber doors 12 for opening or closing the refrigerating chamber 15, and a freezing chamber door 13 for opening or closing the freezing chamber 16. Specifically, the refrigerating chamber 15 and the freezing chamber 16 are partitioned by means of a barrier 111.

In addition, the refrigerator 10 further includes a compressor 32 provided at a lower portion of the main body 11 to compress a refrigerant, an evaporator 31 disposed at a rear portion of the main body 11 to generate cold air, and a blower fan 33 for causing the cold air generated by the evaporator 31 to be supplied into the refrigerating chamber 15 and the freezing chamber 16.

Moreover, the refrigerator 10 farther includes a freezing duct 17 for supplying the cold air blown by the blower fan 33 to the freezing chamber 16, a refrigeration duct 18 for supplying the cold air to the refrigerating chamber 15, an ice maker 20 provided on a ceiling of the refrigerating chamber 15, and an ice bank 21 for storing ice made by the ice maker 20.

Specifically, the freezing duct 17 is provided with a plurality of cold air holes, and the cold air is discharged into the freezing chamber 16 through the cold air holes. Here, in addition to the structure in which the evaporator 31 and the blower fan 33 are disposed in the freezing duct 17, the evaporator 31 and the blower fan 33 may be provided in a separate space in the main body 11 and a freezing duct 17 connected to the freezing chamber 16 may be separately provided.

Furthermore, the refrigeration duct 18 extends from a space where the evaporator 31 is accommodated, and is then connected to the refrigerating chamber 15 through the barrier 111. Here, in addition to the structure in which the refrigeration duct 18 communicates directly with the space with the evaporator 31 accommodated therein, it should be noted that the refrigeration duct 18 may be branched off from the freezing duct 17.

As shown in the figures, the refrigerating chamber doors 12 are generally provided as side-by-side doors, and the freezing chamber door 13 is generally in the form of a drawer-type door. However, the freezing chamber door 13 may also be provided in the form of side-by-side doors.

With the structure described above, ice made by the ice maker 20 provided on the ceiling of the refrigerating chamber 15 is separated from an ice-making tray (which will be described later) and then falls into the ice bank 21. Here, although not shown, a guide extending from the ice maker 20 or the ice bank 21 may be provided such that the ice separated from the ice maker 20 can safely fall into the ice bank 21.

Specifically, the ice bank 21 has an upper face in the form of an opening, and the opening of the ice bank 21 is positioned below the ice maker 20 when the refrigerating chamber doors 12 are closed.

Meanwhile, in a case where the ice bank 21 is provided in the refrigerating chamber 15 or the refrigerating chamber door 12, there may be a phenomenon by which ice stored in the ice bank is melted and stuck together since the refrigerating chamber 15 is kept at a temperature above zero.

To solve this problem, it is necessary to always maintain the interior of the ice bank 21 at a temperature below zero so that ice is not melted.

Hereinafter, a preferred embodiment of maintaining the interior of the ice bank 21 so that ice is not melted will be described.

The refrigerator 10 of the present invention is constructed such that the ice maker 20 and the ice bank 21 are disposed in the refrigerating chamber.

Specifically, the ice bank 21 includes a cylindrical container 211 with an open upper portion, an auger 212 provided at an inner lower portion of the container 211 to guide ice downward, a crusher 213 integrally connected to a lower end of the auger 212 to crush ice, a motor 214 for driving the crusher 213, and a shaft 215 for connecting the motor 214 to the crusher 213 so as to transmit a rotational force of the motor. Here, the container 211 is not limited to the cylinder-shaped one, but may have a variety of shapes.

Furthermore, the ice maker 20 is provided at a side of the ceiling of the refrigerating chamber 15. Specifically, the ice maker 20 is positioned above the ice bank 21 such that ice discharged from the ice maker 20 can fall into the container 211. The configuration of the ice maker 20 and an ice-making process using the same will be described below with reference to the accompanying drawings.

Meanwhile, the refrigeration duct 18 communicates with the space where the evaporator 31 is accommodated, and then extends upward along a wall of the refrigerating chamber 15 and to the ceiling of the refrigerating chamber 15. Then, an end of the refrigeration duct 18 extends to a front portion of the refrigerating chamber 15 and is positioned above the container 211. Thus, cold air flowing along the refrigeration duct 18 is discharged forward, and a portion of the discharged cold air falls into the container, and the remainder of the cold air circulates in the refrigerating chamber 15.

With this structure, at least a portion of cold air, which has been cooled to a relatively lower temperature while passing through the evaporator 31, is discharged directly into the container 211, thereby effectively preventing a phenomenon by which ice accommodated in the container 211 is melted and stuck together.

Further, since the refrigeration duct 18 extends to the front portion of the refrigerating chamber 15 and the cold air discharged from the refrigeration duct 18 is discharged downward, it is possible to obtain an air curtain effect.

Figure 3:
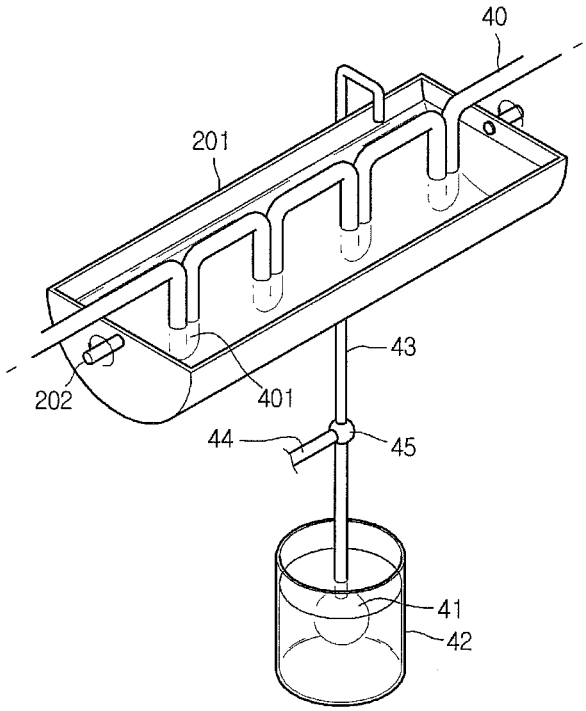
FIG. 3 is a perspective view schematically showing the ice maker according to the present invention.

FIG. 3 is a perspective view schematically showing the ice maker according to the present invention.

Hereinafter, in order to clarify the spirit of the present invention, descriptions on supplementary components constituting the ice maker, i.e., components that do not directly have influence on the present invention, such as a case or a cover, will be omitted since they may be substantially identical to those of a conventional ice maker.

Referring to FIG. 3, the ice maker 20 according to the present invention includes an ice-making tray 201 for containing water to be used for making ice, an ice-making pipe 40 extending to the interior of the ice-making tray 201, and a water supplier for supplying water to the ice-making tray 201.

Specifically, the water supplier includes a water container 42 for storing water, a pump 41 for pumping water into the water container 42, and a water supply pipe 43 extending from the pump 41 to the ice-making tray 201. In addition, a dispenser connection pipe 44 may be branched off from any one side of the water supply pipe 43, and a switching valve 45 may be mounted at the branch point, so that it is possible to selectively control a water flow direction. In more detail, the dispenser connection pipe 44 may extend toward a dispenser 14, thereby enabling a user to take drinking water.

Meanwhile, rotary shafts 202 extend from both sides of the ice-making tray 201, respectively, and are connected to a case (not shown) surrounding the ice-making tray 201.

In addition, the ice-making pipe 40, in which a portion of a refrigerant in a refrigeration cycle flows, is curved or bent several times to form protrusions 401 as shown in the figure. At this time, the protrusions 401 are partially submerged in water stored in the ice-making tray 201. The piping structure of the ice-making pipe 40 will be described in more detail below with reference to the accompanying drawings.

An ice-making process using the above configuration will be briefly described as follows. A refrigerant of relatively low temperature flows into the ice-making pipe 40, so that the water in the ice-making tray 201 is frozen on surfaces of the protrusions 401. Then, at any time point, the ice-making tray 201 is rotated to remove the remaining water, and a refrigerant of relatively high temperature flows into the ice-making pipe 40. Thereafter, ice from the frozen surfaces of the protrusions 401 is separated, and the separated ice falls into and is stored in the ice bank 21.

Figure 4:
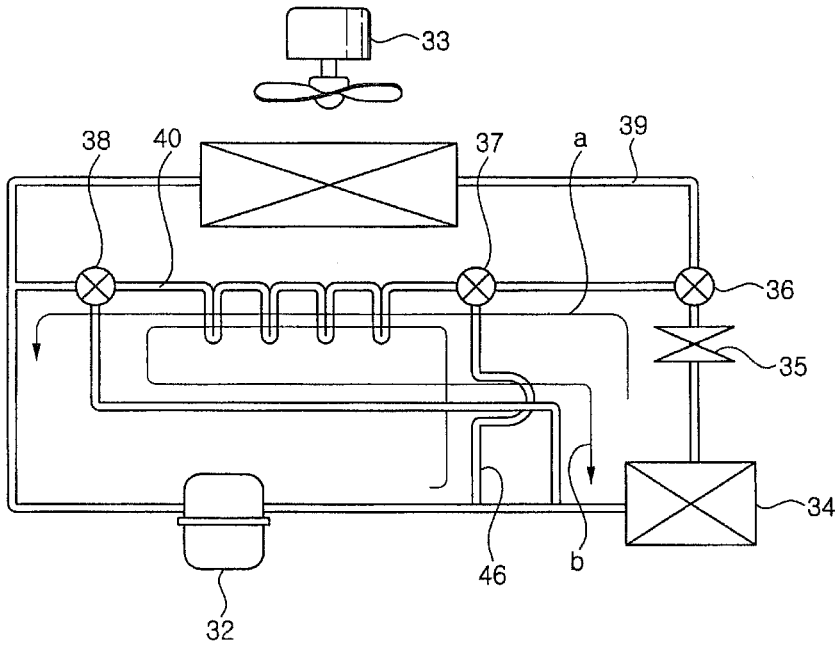
FIG. 4 shows a refrigerant circulating system of the refrigerator according to the present invention.

FIG. 4 shows a refrigerant circulating system of the refrigerator according to the present invention.

Referring to FIG. 4, the refrigerant circulating system of a refrigerator according to the present invention includes a compressor 32 for compressing a refrigerant, a condenser 34 for condensing the refrigerant compressed at relatively high temperature and high pressure by the compressor 32, an expansion valve 35 for expanding the refrigerant, which has passed through the condenser 34, into a refrigerant of relatively low temperature and low pressure, and an evaporator 31 for heat exchanging the refrigerant, which has passed through the expansion valve, with air. In addition, the compressor 32, the condenser 34, the expansion valve 35 and the evaporator 31 are connected through refrigerant pipes 39.

Specifically, a blower fan 33 is provided at one side of the evaporator 31, so that cold air, which passes through the evaporator and is cooled by the heat exchange, is supplied to the refrigerating chamber or freezing chamber. In addition, the ice-making pipe 40 is branched off from an outlet of the expansion valve 35, and an outlet of the ice-making pipe 40 is branched into two paths that in turn are connected respectively to an outlet of the evaporator 31 and an inlet of the condenser 34. Also, a first valve 36 is mounted at a point where the ice-making pipe 40 is branched off from the outlet of the expansion valve 35, and performs control such that a portion of the refrigerant, which has passed through the expansion valve 35, is caused to flow to the ice-making pipe 40. In addition, a third valve 38 is provided at a point where the outlet of the ice-making pipe 40 is branched into the two paths, and performs control such that the refrigerant is caused to selectively flow to any one of the outlet of the evaporator 31 and the inlet of the condenser 34. Further, an ice-releasing pipe 46 is branched off from the outlet of the compressor 32 and extends to an inlet of the ice-making pipe 40. In addition, a second valve 37 is provided at a point where the ice-releasing pipe 46 meets the inlet of the ice-making pipe 40, so that a portion of a refrigerant of relatively high temperature and high pressure is caused to selectively flow to the ice-making pipe 40.

The refrigerant circulating process performed in ice-making and ice-releasing processes of the refrigerant system configured as above will be described.

First, when a refrigerator is operated, the refrigeration cycle works. That is, the refrigerant is compressed by the compressor 32 into a vapor refrigerant of relatively high temperature and high pressure, and the compressed refrigerant is heat exchanged with the external air while passing through the condenser 34 and is thus changed into a liquid refrigerant of relatively high temperature and high pressure. Then, the refrigerant, which has passed through the condenser 34, passes through the expansion valve 35 and is changed into a two-phase refrigerant of relatively low temperature and low pressure. Thereafter, the two-phase refrigerant of relatively low temperature and low pressure is heat exchanged with the external air while passing the evaporator 31 and is changed into a vapor refrigerant of relatively low temperature and low pressure. The air that is heat exchanged in the evaporator 31 becomes in a relatively low temperature state and is then supplied to the refrigerating chamber or the freezing chamber by means of the blower fan 33. Also, the refrigerant, which has passed through the evaporator 31, is introduced into the compressor 32 again.

Specifically, during the ice-making process, a portion of the refrigerant flows along line a, whereas during the ice-releasing process, a portion of the refrigerant flows along line b.

Specifically, the degree of opening of the first valve 36 is controlled while the ice-making process is performed, so that a portion of the refrigerant, which has passed through the expansion valve 35, is supplied to the ice-making pipe 40. Then, the refrigerant, which has passed through the ice-making pipe 40, freezes the water stored in the ice-making tray 201. The refrigerant, which has passed through the ice-making pipe 40, is moved toward the outlet of the evaporator 31 and is then introduced into the compressor 32 again.

Meanwhile, if the ice-making process is completed and the ice-releasing process is initiated, the degree of opening of the first valve 36 is again controlled to block the supply of the refrigerant of relatively low temperature and low pressure to the ice-making pipe 40. On the contrary, the second valve 37 is controlled such that a vapor refrigerant of relatively high temperature and high pressure flowing along the ice-releasing pipe 46 is supplied to the ice-making pipe 40. Then, as the temperature of the ice-making pipe 40 is increased, ice adhering to the protrusions 401 of the ice-making pipe 40 is separated therefrom.

Moreover, during the ice-releasing process, the degree of opening of the third valve 38 is controlled such that the refrigerant passing through the ice-making pipe 40 flows again toward the outlet of the compressor 32.

Here, it should be noted that the point where the outlet end of the ice-making pipe 40 is connected may be suitably changed without being limited to the illustrated embodiment. Further, it should be noted that in addition to the method in which the refrigerant which has passed through the compressor is caused to flow to the ice-making pipe 40 in the ice-releasing process, the cycle may also be configured such that the refrigerant which has passed through the condenser is caused to flow to the ice-making pipe 40.

FIGS. 5 to 8 are views sequentially showing the ice-making and ice-releasing processes performed in the ice maker according to the present invention.

Figure 5:
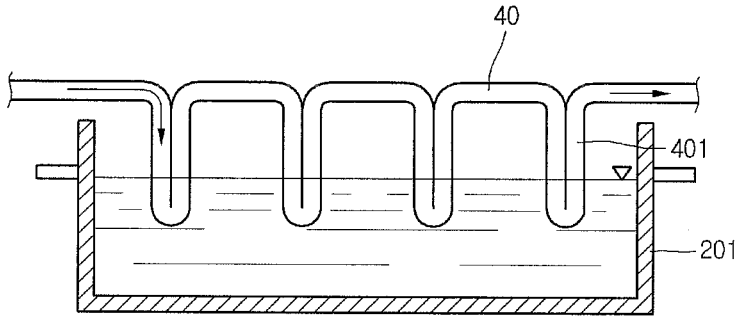
FIGS. 5 to 8 are views sequentially showing ice-making and ice-releasing processes performed in the ice maker according to the present invention.

Referring to FIG. 5, the water stored in the water container 42 is supplied to the ice-making tray 201 along the water supply pipe 43 by means of the pump 41.

Specifically, it is preferred that the water be supplied to the ice-making tray 201 so that at least the protrusions of the ice-making pipe 40 are submerged in the water up to a certain level. In addition, if the water is supplied to the ice-making ray 201 to reach a preset level, the operation of the pump 41 is stopped. Also, the refrigerant, which has passed through the ice-making pipe 40, is allowed to flow to the expansion valve 35.

Figure 6:
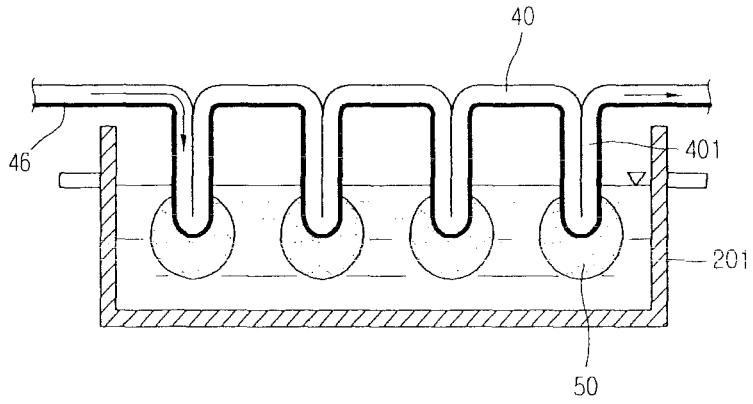

Referring to FIG. 6, while the refrigerant of relatively low temperature and low pressure flows to the ice-making pipe 40, the refrigerant is heat exchanged with the water stored in the ice-making tray 201, and as a result, the water stored in the ice-making tray 201 starts to be frozen. Here, the water in the ice-making tray 201 starts to be frozen from the surfaces of the protrusions 401 of the ice-making pipe 40. That is, the water starts to be frozen from the surfaces of the protrusions 401, and the size of frozen ice 50 increases as time goes.

Meanwhile, since the protrusions 401 are formed at certain intervals, ice formed on each protrusion 401 may be stuck to adjacent ice as its size increases. Here, the refrigerant is caused to stop being supplied to the ice-making pipe 40 just before the ice formed on the protrusions 401 is stuck together.

Figure 7:
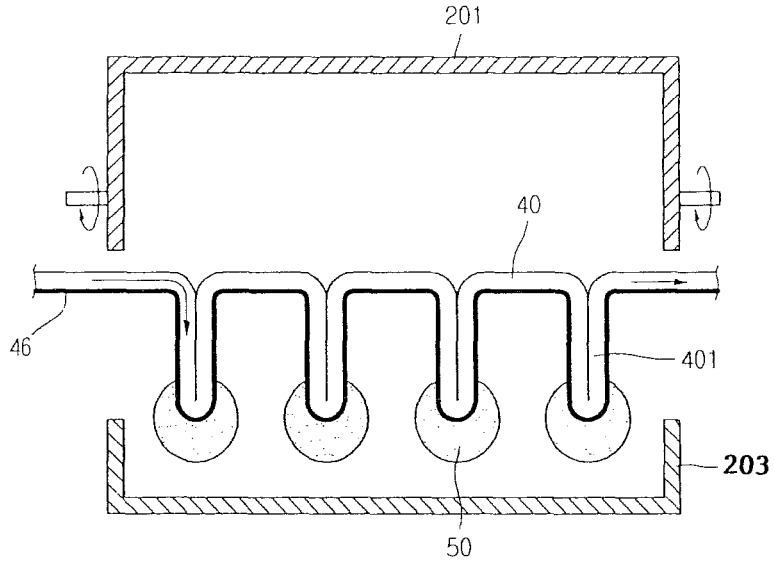

Referring to FIG. 7, the ice-making process is completed just before the ice formed on the protrusions 401 of the ice-making pipe 40 is stuck together, and then, the ice-making tray 201 is rotated to remove the water remaining in the ice-making tray 201.

Specifically, a remaining water receiver 203 is positioned below the ice-making ray 201, so that the wasted remaining water is prevented from falling and flowing into the refrigerating chamber when the ice-making tray 201 starts rotating.

Here, the remaining water receiver 203 may be provided as a component of the ice maker 20 to thereby cooperate with the ice-making tray 201, or also be provided below the ice maker 20 as an additional component. That is, it is possible to propose any configuration of the remaining water receiver 203 if it is extracted to a position below the ice-making tray 201 when the ice-making tray 201 rotates and then returns to its original position after the remaining water is completely removed. Thus, a description of the configuration of the remaining water receiver 203 will be omitted.

Figure 8:
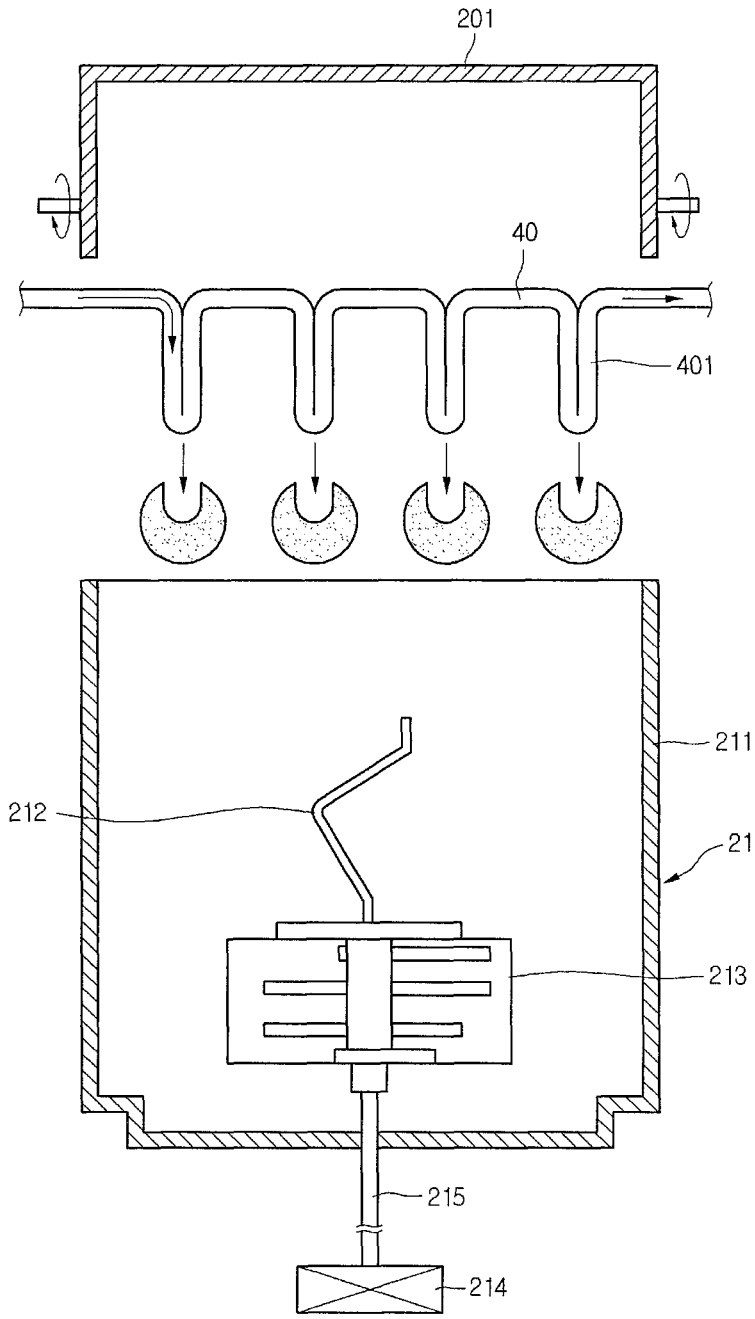

Referring to FIG. 8, after the remaining water is completely removed, the remaining water receiver 203 returns to its original position, so that the ice bank 21 is positioned directly below the ice-making pipe 40.

Specifically, when the remaining water is removed and the ice-releasing process is performed, the refrigerant of relatively high temperature and high pressure is caused to flow to the ice-making pipe 40 as explained in connection with the above cycle. Then, the temperature of the ice-making pipe 40 is increased so that ice adhering to the protrusions 401 is separated therefrom. Then, the separated ice 50 falls into the container 211 of the ice bank 21 and is stored therein. Since the configuration of the ice bank 21 is already described above, the description thereof will be omitted.

Also, in a case where the ice-making tray 201 has a different size from the container 211 or the ice bank 21 is provided in front of the ice maker 20, an additional guide member may be provided so that the falling ice does not escape from the container 211. As mentioned above as an example, the guide member may extend from the opening of the container 211 toward the ice-making tray 201 or from the ice maker 20 toward the container 211.

According to the aforementioned ice-making structure, there is no need for forming an additional cold air flow passage to supply a portion of refrigerant to the ice maker in order to make ice, whereby it is possible to secure a large inner space of the refrigerating or freezing chamber.

According to the system and method for making ice of the present invention as described above, there is no need for forming an additional duct to supply cold air to the ice maker in order to make ice, whereby it is possible to simplify a manufacturing process of a refrigerator and to reduce manufacturing costs of a refrigerator.

In addition, since a portion of refrigerant used in a refrigeration cycle of a refrigerator is used for making ice, no additional energy is required for making ice, thereby reducing energy consumption.

Further, although the ice maker is provided in a refrigerating chamber, the ice-making process can be smoothly performed.

Furthermore, since there is no need for forming an additional cold air flow passage to supply a portion of refrigerant to the ice maker in order to make ice, it is possible to secure a large inner space of the refrigerating or freezing chamber.

In addition, the structure described above enables transparent ice to be easily made.

What is claimed is:

1. A refrigerator, comprising:

a main body including at least one refrigerating chamber and at least one freezing chamber;

an ice maker installed in an inside of the at least one refrigerating chamber;

a container positioned in a refrigerating chamber door, wherein an outer surface of the container is exposed to the inside of the at least one refrigerating chamber, and wherein the container is positioned so as to receive ice from the ice maker; and a cold air flow passage that supplies cold air to the container to maintain ice received in the container in a frozen state, wherein the cold air flow passage extends along a ceiling of the refrigerating chamber, wherein the ice maker comprises:

a tray that receives water therein to be used for making ice; and an ice-making pipe positioned so that at least a portion of the ice making pipe is submerged in water received in the tray, wherein the ice-making pipe receives low temperature refrigerant during an ice-making process, and receives high temperature refrigerant during an ice-releasing process, and wherein:

one or more holes located at an end section of the cold air flow passage is the only hole or are the only holes that direct cold air into the at least one refrigerating chamber, the cold air passage is separated from being in communication with an interior of the at least one refrigerating chamber continuously from a first point to a second point, the first point corresponds to a point at which the cold air passage enters the at least one refrigerating chamber and the second point corresponds to a point where the one or more holes are located, and the cold air passage includes no air intake ports in the at least one refrigerating chamber between the first point and the second point.

2. The refrigerator of claim 1, wherein the tray is configured to be selectively rotated to remove water remaining in the tray before the water in the tray is completely frozen and made into ice.

3. The refrigerator as claimed in claim 1, wherein the ice-making pipe receives relatively low temperature and low pressure refrigerant that has been subjected to an expansion process during the ice-making process, and receives relatively high temperature and high pressure refrigerant that has passed through a compressor or condenser during the ice-releasing process.

4. The refrigerator as claimed in claim 1, wherein the ice-making pipe is curved a plurality of times so as to form a plurality of protrusions, and wherein each of the plurality of protrusions is at least partially submerged in water received in the tray such that ice is formed on a surface of each of the plurality of protrusions during the ice-making process.

5. The refrigerator as claimed in claim 1, wherein the cold air flow passage comprises a duct member having the one or more holes positioned above an opening of the container.

6. The refrigerator as claimed in claim 1, wherein the container is disposed adjacent to the cold air flow passage.

7. The refrigerator as claimed in claim 1, wherein the container has an opening at an upper portion, and at least a portion of the cold air discharged from the cold air flow passage through the one or more holes is discharged to the opening of the container.

8. The refrigerator as claimed in claim 7, wherein a remaining portion of the cold air discharged from the cold air flow passage through the one or more holes is discharged into the at least one refrigerating chamber.

9. The refrigerator as claimed in claim 1, wherein a portion of the cold air discharged from the cold air flow passage is supplied to the ice maker.

10. A refrigerator, comprising:

a main body including at least at least one refrigerating chamber and at least one freezing chamber;

a compressor;

a condenser that receives compressed refrigerant from the compressor;

an expander that receives condensed refrigerant from the condenser and expands the received refrigerant into a relatively low temperature and low pressure refrigerant;

an ice-making pipe extending from an outlet of the expander, the ice-making pipe being curved or bent several times so as to form a plurality of protrusions;

a tray that receives water to be used for making ice, wherein the tray is configured to selectively rotate during an ice-making process; and a cold air flow passage that supplies cold air to a container so as to maintain ice received from the tray and stored in the container in a frozen state, wherein the cold air flow passage extends along a ceiling of the refrigerating chamber, wherein the plurality of protrusions are at least partially submerged in the water received in the tray, and wherein:

one or more holes located at an end section of the cold air flow passage is the only hole or are the only holes that direct cold air into the at least one refrigerating chamber, the cold air passage is separated from being in communication with an interior of the at least one refrigerating chamber continuously from a first point to a second point, the first point corresponds to a point at which the cold air passage enters the at least one refrigerating chamber and the second point corresponds to a point where the one or more holes are located, and the cold air passage includes no air intake ports in the at least one refrigerating chamber between the first point and the second point.

11. The refrigerator as claimed in claim 10, further comprising an ice-releasing pipe that branches off from an outlet of the compressor or condenser and is connected to an inlet of the ice-making pipe so that relatively high temperature refrigerant flows to the ice-making pipe during an ice-releasing process.

12. The refrigerator as claimed in claim 11, further comprising a valve that allows relatively high temperature refrigerant that has passed through the compressor or condenser to selectively flow to the ice-releasing pipe.

13. The refrigerator as claimed in claim 10, wherein the tray is configured to selectively rotate to remove water remaining in the tray before ice formed on adjacent protrusions of the plurality of protrusions comes into contact with each other.

14. The refrigerator as claimed in claim 10, further comprising a valve that allows at least a portion of refrigerant that has passed through the expander to selectively flow to the ice-making pipe.

15. The refrigerator as claimed in claim 10, further comprising a valve provided at an outlet of the ice-making pipe, wherein the valve allows refrigerant that has passed through the ice-making pipe to again flow to an inlet or outlet of the compressor.

16. The refrigerator as claimed in claim 10, further comprising a water supply that supplies water to the tray.

* * * * *